US005663699A

United States Patent [19]

Shiroyama

[11] Patent Number: 5,663,699

[45] Date of Patent: Sep. 2, 1997

[54] STARTER MAGNET SWITCH

[75] Inventor: Shigeru Shiroyama, Hyogo, Japan

[73] Assignee: Mitsubishi Denki Kabushiki Kaisha, Tokyo, Japan

[21] Appl. No.: 527,983

[22] Filed: Sep. 14, 1995

[30] Foreign Application Priority Data

Oct. 28, 1994 [JP] Japan ..... 6-288829

[51] Int. Cl.[6] ..... H01H 67/02

[52] U.S. Cl. ..... 335/126; 335/131

[58] Field of Search ..... 335/126, 131

[56] References Cited

U.S. PATENT DOCUMENTS 5,157,367 10/1992 Itoh et al. ..... 335/126
5,291,170 3/1994 Whba et al. ..... 335/126
5,348,232 9/1994 Babitzka et al. ..... 335/126
5,424,700 6/1995 Santarelli ..... 335/131

FOREIGN PATENT DOCUMENTS 2-27739 7/1990 Japan ..... F16K 31/06
5-41149 2/1993 Japan ..... H01H 50/02

*Primary Examiner*—Lincoln Donovan
*Attorney, Agent, or Firm*—Sughrue, Mion, Zinn, Macpeak & Seas

[57] ABSTRACT

A connecting terminal housing is integrated with a switch operating current supplying connecting terminal by insert-molding the terminal with resin so that the connecting terminal housing can be attached to a vehicle-side connector. A watertight rubber for preventing infiltration of water from the vehicle-side connector is fitted with the connecting terminal housing. Then, the connecting terminal is electrically connected to lead wires of the starter magnet switch main body.

15 Claims, 5 Drawing Sheets

STARTER MAGNET SWITCH

BACKGROUND OF THE INVENTION

The invention relates to a starter magnet switch that is used to start internal combustion engines. More particularly, the invention is directed to the structure for coupling a connecting terminal for supplying a starter magnet switch operating current with a vehicle-side connector.

FIG. 8 is a sectional view showing the connecting terminal portion of a conventional starter magnet switch.

In FIG. 8, reference numeral 40 denotes a switch operating current supplying terminal coupler made of a thermoplastic resin. This coupler 40 is connected to a switch operating current supplying terminal 30 to be assembled to a vehicle-side coupler (not shown), the terminal 30 being fixed onto a mold cover 42 of the magnet switch main body. The switch operating current supplying terminal coupler 40 has a locking portion 40*a* that allows the vehicle-side coupler to be coupled thereto, a cylindrical coupling portion 40*b*, and a positioning inner portion 40*c* as an integral part thereof. Reference numeral 70 denotes a cylindrical watertight rubber for the vehicle-side connector. This watertight rubber 70 is fitted with the inner circumferential wall of the coupling portion 40*b*, and accommodates the front end portion of the switch operating current supplying terminal 30 within the inner space thereof. Reference numeral 80 denotes a rodlike watertight rubber for the switch operating current supplying terminal, and allows the base portion of the terminal 30 to be inserted into a slit hole 80*a* formed at the center thereof.

The process of assembling the aforementioned device will be described next.

After setting the switch operating current supplying terminal watertight rubber 80 to the switch operating current supplying terminal 30 through the slit hole 80*a*, the inner portion 40*c* of the switch operating current supplying terminal is fitted on the outer circumference of the watertight rubber 80, and the inner portion 40*c* is then positioned with respect to a mold cover receiving portion 42*a* in radial directions. After this positioning operation, the vehicle-side connector watertight rubber 70 is fitted with the inner circumference of the coupling portion 40*b*.

According to the aforementioned conventional device, the switch operating current supplying terminal coupler 40, the vehicle-side connector watertight rubber 70, and the switch operating current supplying terminal watertight rubber 80 are prepared as separate components, and in addition, these components must then be assembled to the switch operating current supplying terminal 30. This leads to a problem that the assembling operation not only becomes complicated but also involves a large number of process steps.

SUMMARY OF THE INVENTION

The invention has been made to overcome this problem. The object of the invention is, therefore, to provide a connecting terminal structure of a starter magnet switch, the structure requiring only a small number of components to be prepared, being simple, and involving such a small number of assembling process steps as to ensure assembling ease.

According to the invention, a starter magnet switch includes: a connecting terminal for supplying starter magnet switch operating current; a connecting terminal housing formed by insert-molding the connecting terminal so as to be attachable to a vehicle-side connector; and a watertight rubber being fitted with an inner wall of the connecting terminal housing so as to prevent infiltration of water from the vehicle-side connector. The connecting terminal is electrically connected to a starter magnet switch main body.

In the structure of the invention, the connecting terminal housing is integrated with the switch operating current supplying connecting terminal by insert-molding with resin, and the connecting terminal is electrically connected to the starter magnet switch main body. Therefore, the invention can provide a starter magnet switch using a small number of components, having a simple structure, and requiring a small number of assembling process steps in coupling the switch operating current supplying connecting terminal to the starter magnet switch main body.

Further, the vehicle-side connector watertight rubber prevents infiltration of water from the vehicle-side connector housing, and infiltration of water from outside the connecting terminal housing can be prevented by the insert-molded resin that is in tight contact.

Further, according to the invention, it is preferable that the thickness of the connecting terminal on a side to be fixed to the starter magnet switch main body is larger than the thickness thereof on a side to be fitted with the vehicle-side connector. The deformation of the connecting terminal housing can be prevented when an external force is applied to the connecting terminal housing.

Furthermore, according to the invention, it is preferable that the connecting terminal side to be fixed to the starter magnet switch main body and the connecting terminal side to be fitted with the vehicle-side connector are separate from each other, and that both sides are fixed to each other by welding. Not only can the deformation of the connecting terminal housing be prevented, but also standard products (e.g. JIS: Japanese Industrial Standard) can be used as the connecting terminal side to be fitted with the vehicle-side connector.

Moreover, according to the invention, it is preferable that the connecting terminal is set into a recessed portion arranged in a mold cap of the starter magnet switch main body, and that the connecting terminal and the mold cap are fixed to each other by an eyelet. The Connecting terminal can be fixed to the starter magnet switch main body easily as well as reliably.

Still further, according to the invention, it is preferable that a fixing terminal fixed to the starter magnet switch main body is fixed to the connecting terminal by screwing. The connecting terminal of the connecting terminal housing is completed by screwing the connecting terminal to the fixing terminal that has been fixed to the starter magnet switch in advance. Therefore, the assembling process can be simplified.

Still further, according to the invention, it is preferable that a projection is provided on one of the surfaces on which the fixing terminal and the connecting terminal are bonded to each other, and that an insertion hole for allowing the projection to be inserted thereinto is provided on the other one of the surfaces. Not only is the positioning of the fixing terminal with respect to the connecting terminal facilitated, but also the fixing terminal can be fixed to the connecting terminal in a plurality of directions. Further, the loosening of the screw can be prevented even if an external force is applied to the connecting terminal housing.

Still further, according to the invention, it is preferable that a soft viscous resin material is applied to a surface on which the connecting terminal and the connecting terminal housing are bonded to each other. The tight contact between the connecting terminal and the connecting terminal housing can be improved, which in turn contributes to increasing watertightness.

DETAILED DESCRIPTION OF PREFERRED EMBODIMENTS

Embodiment 1

First, the general structure of a starter magnet switch, which is Embodiment 1 of the invention, will be described with reference to FIG. 1.

Figure 1:
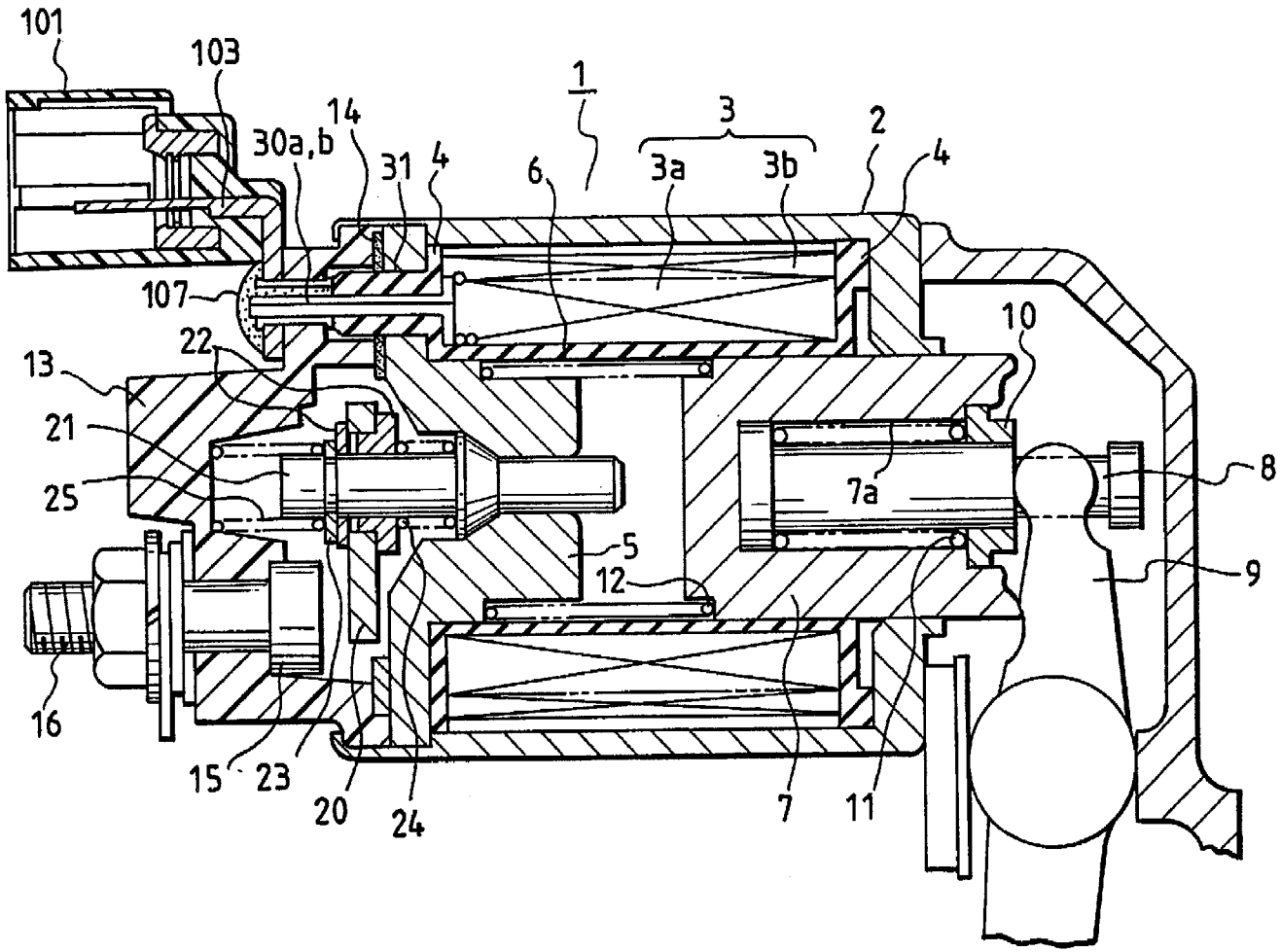
FIG. 1 is a sectional view showing the general structure of a starter magnet switch, which is Embodiment 1 of the invention.

In FIG. 1, reference numeral 2 denotes a magnetic case of the starter magnet switch 1. Inside the magnetic case 2 is a resin bobbin 4 having an attracting coil 3*a* and a holding coil 3*b* wound. Reference numeral 5 denotes a fixed iron core of the starter magnet switch 1. Opposite to the fixed iron core 5 is a movable iron core 7 that slides along a guide bush 6 arranged over the inner circumference of the bobbin 4. The rear end portion of a hook 8 is inserted into a hole 7*a* formed in the front end portion of the movable iron core 7, and the top end portion of a shift lever 9 is engaged with the hook 8, so that an overrunning clutch (not shown) can be driven. Reference numeral 10 denotes a sleeve bearing mounted on the exit of the hole 7*a* of the movable iron core 7; 11, a compression spring that compresses the hook 8 rearward; 12, a return spring of the movable iron core 7; and 13, a mold cap attached to the rear end portion of the fixed iron core 5 through a packing 14.

Further, the starter magnet switch 1 has a fixed contact 15, and a terminal bolt 16 of the contact 15 projects outward from the mold cap 13. On the other hand, a movable contact 20 confronts the fixed contact 15. The movable contact 20 is not only given contact compression by an insulating member 22, a holding ring 23, and a compression spring 24, but also supported by a movable rod 21. Reference numeral 25 denotes a compression spring for compressing the movable rod 21 toward the fixed iron core 5.

Still further, a spool 31 is formed on the rear end portion of the bobbin 4 so that lead wires 30*a*, 30*b* of the coils 3*a*, 3*b* are paid out. These lead wires 30*a*, 30*b* are electrically connected to a switch operating current supplying connecting terminal 103 that is arranged integrally with a connecting terminal housing 101 as will be described in detail with reference to FIG. 2.

Figure 2A:
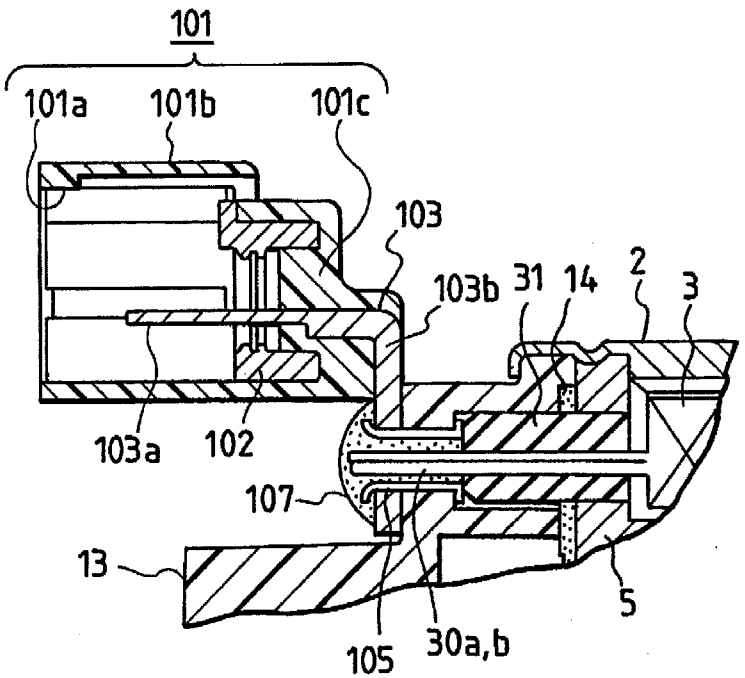
FIGS. 2A and 2B are sectional views showing the connecting terminal portion of the starter magnet switch shown in FIG. 1.
Figure 2B:
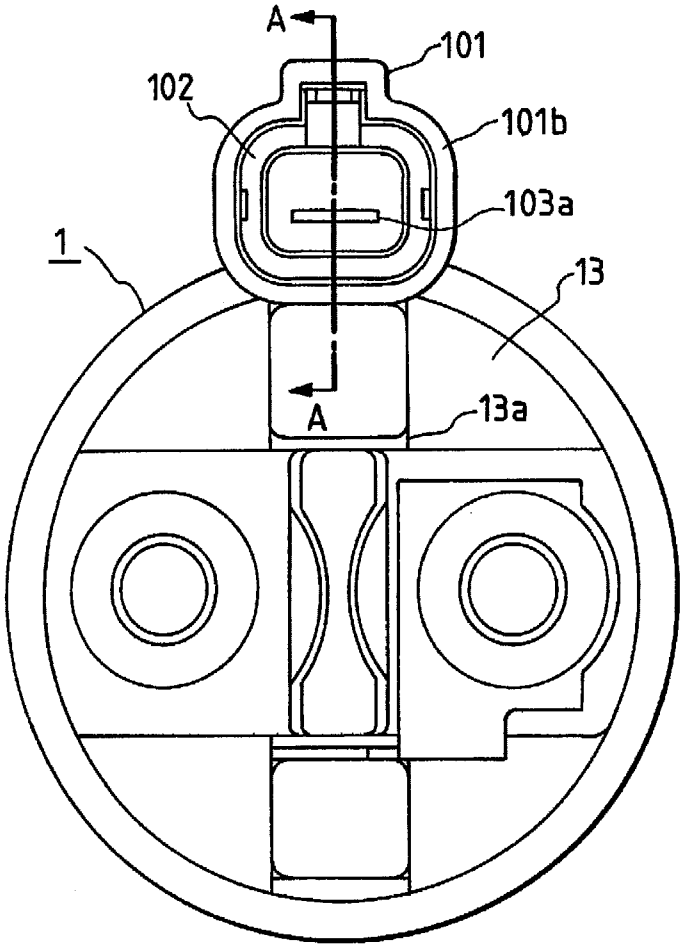

FIG. 2A is an enlarged sectional view showing a connecting terminal portion of the starter magnet switch of Embodiment 1, and FIG. 2B is a side outline view thereof.

In FIGS. 2A and 2B, reference numeral 101 denotes the connecting terminal housing made of resin by integral molding. The connecting terminal housing 101 has a locking portion 101*a* that makes a vehicle-side connector housing (not shown) attachable thereto, a cylindrical coupling portion 101*b* for coupling the vehicle-side connector housing, and a resin bonded portion 101*c* formed by insert-molding the connecting terminal 103. Reference numeral 102 denotes a cylindrical watertight rubber. The watertight rubber 102 is fitted with the inner circumferential walls of the coupling portion 101*b* and the resin bonded portion 101*c*, and accommodates a connecting terminal portion 103*a* that is to be fitted with the vehicle-side connector within the inner space thereof. A connecting terminal portion 103*b* that is to be fixed to the starter magnet switch main body is fixed to the mold cap 13 by an eyelet 105. The inner space of the eyelet 105 is such that the lead wires 30*a*, 30*b* of the attracting coil and the holding coil are electrically connected to the connecting terminal portion 103*b* with solder 107. Further, the connecting terminal portion 103*b* to be fixed is made thicker than the connecting terminal portion 103*a* to be fitted for reinforcement purposes. Still further, a recessed groove 13*a* is formed in the mold cap 13 so that the connecting terminal portion 103*b* can be guided thereby.

The assembling process of Embodiment 1 will be described next.

First, the connecting terminal housing 101 is prepared out of resin by integral molding, the connecting terminal housing 101 having the locking portion 101*a*, the cylindrical coupling portion 101*b*, and the resin bonded portion 101*c* with the connecting terminal 103 inserted thereinto. Then, after having the watertight rubber 102 fitted with the inner circumferential walls of the coupling portion 101*b* and the resin bonded portion 101*c* of the connecting terminal housing, the connecting terminal portion 103*b* to be fixed that is exposed from the connecting terminal housing 101 is fixed to the mold cap 13 through the eyelet 105 and electrically connected to the lead wires 30*a*, 30*b* of the coils with the solder 107. The vehicle-side connector (not shown) is fixed to the locking portion 101*a* of the connecting terminal housing 101.

The watertight rubber 102 prevents infiltration of water from the vehicle-side connector, whereas the resin bonded portion 101*c* of the connecting terminal housing 101 in tight contact with the connecting terminal 103 prevents infiltration of water from the connecting terminal portion 103*b*. Moreover, if further improved contact is required, a seal member made of a soft viscous resin may be applied to the connecting terminal 103 in advance and the connecting terminal housing may be subjected to insert-molding using resin as disclosed in Post-examined Japanese Utility Model Publication No. 2-27739 (1990).

Embodiment 2

Figure 3:
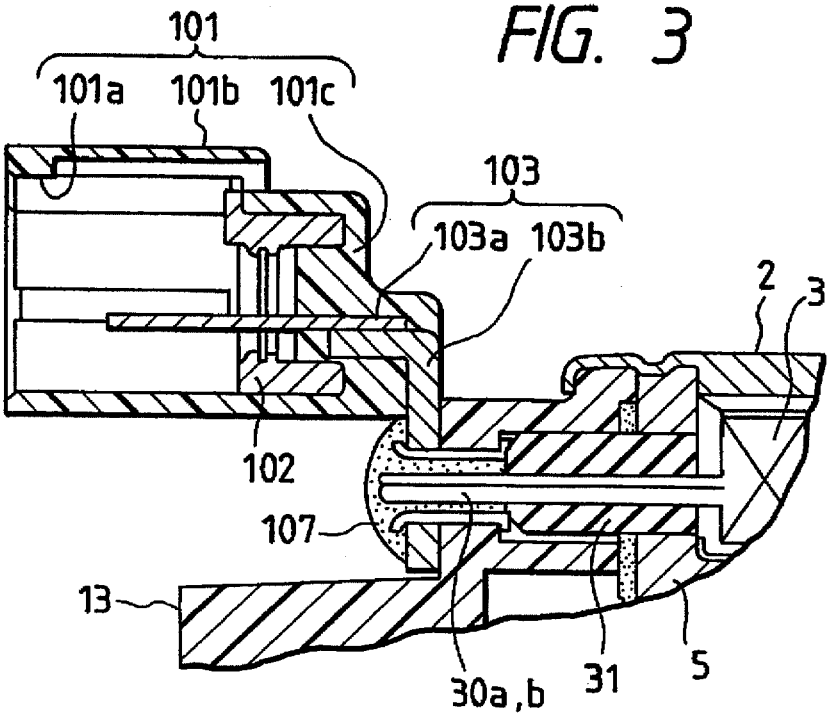
FIG. 3 is a sectional view showing the connecting terminal portion of a starter magnet switch of Embodiment 2.
Figure 4:
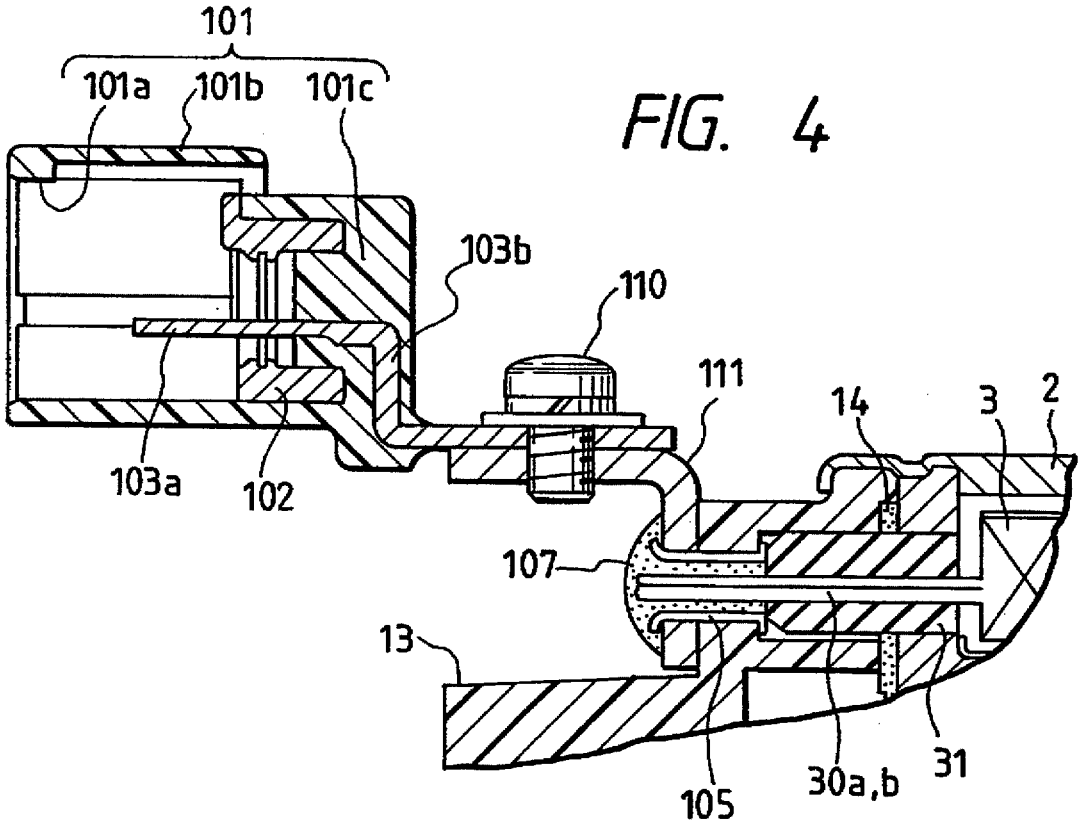
FIG. 4 a sectional view showing the connecting terminal portion of a starter magnet switch of Embodiment 3.

FIG. 3 shows the connecting terminal portion of a starter magnet switch, which is Embodiment 2 of the invention. The starter magnet switch according to Embodiment 2 is characterized as forming the connecting terminal 103 according to Embodiment 1 of two separate pieces, a fitted portion 103*a* and a fixed portion 103*b*, then welding the fitted portion 103*a* and the fixed portion 103*b* together, and thereafter subjecting the thus prepared connecting terminal 103 to insert-molding using resin to form the connecting terminal housing 101. A male blade (PA) for vehicles (JIS D5403) is generally used as the fitted portion 103*a*. The fitted portion is made of a 0.8 mm brass sheet. The fixed portion 103*b* is formed of an electrically conducting metal sheet whose thickness is larger than 0.8 mm so as to prevent the fixed portion 103*b* from being deformed when a force is applied to the connecting terminal housing 101.

Embodiment 3

FIGS. 4 to 7 show the connecting terminal portion of a starter magnet switch, which is Embodiment 3 of the invention.

The starter magnet switch according to Embodiment 3 is characterized as fixing the connecting terminal 103 according to Embodiment 1 to the cap mold 13 while interposing an L-shaped fixing terminal 111 therebetween, instead of fixing the connecting terminal directly into the eyelet 105. The fixing terminal 111 is fixed to the mold cap 13 by the eyelet 105, and the lead wires 30*a*, 30*b* of the coil 3 is electrically connected to the inner space of the eyelet 105 using the solder 107.

Figure 5:
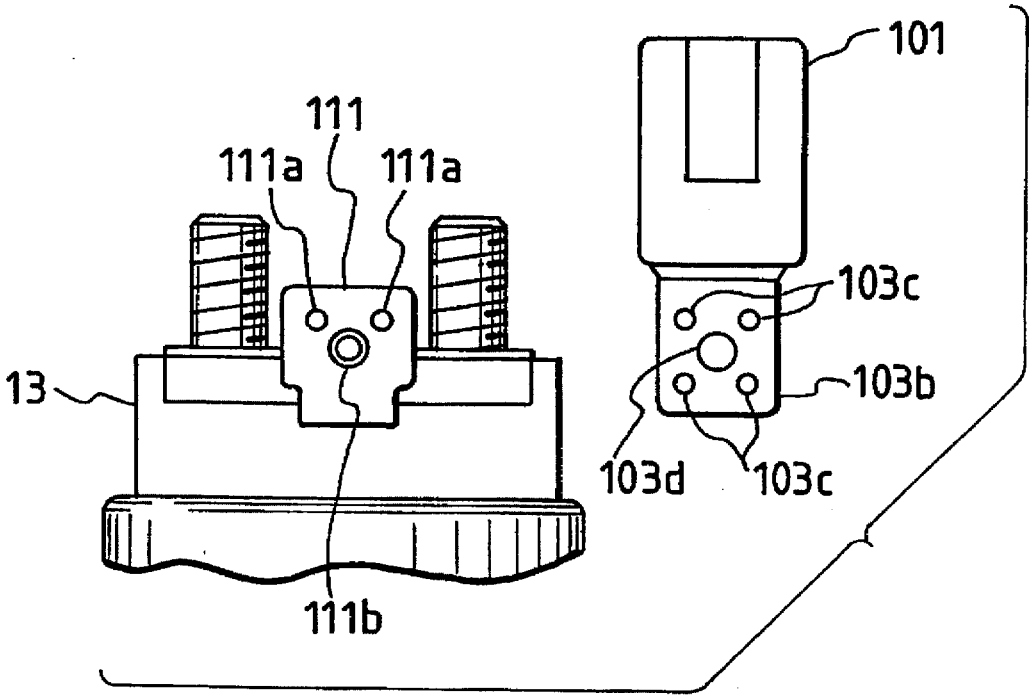
FIG. 5 is plan view showing a connecting terminal housing and a fixing terminal portion of the starter magnet switch of Embodiment 3.

As shown in a plan view of FIG. 5, the fixing terminal 111 has guide projections 111*a* half-blanked so that the guide projections 111*a* are inserted into and positioned with respect to guide holes 103*c* of the fixed portion 103*b* of the connecting terminal 103. A female screw threads 111*b* are cut in the fixing terminal 111 so that the fixing terminal 111 can be fixed by a male screw 110 through a screw hole 103*d* of the fixed portion 103*b* of the connecting terminal.

Figure 6:
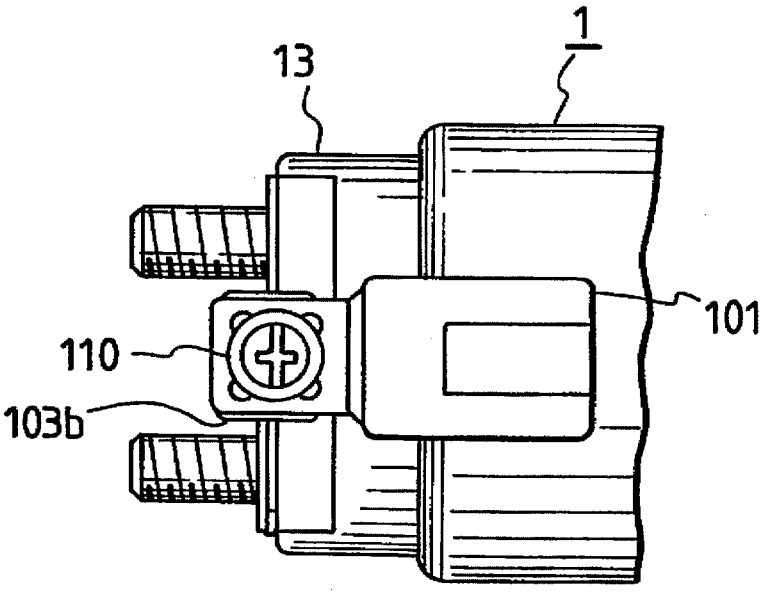
FIG. 6 is a plan view showing how the connecting terminal housing of the starter magnet switch of Embodiment 3 is assembled.
Figure 7:
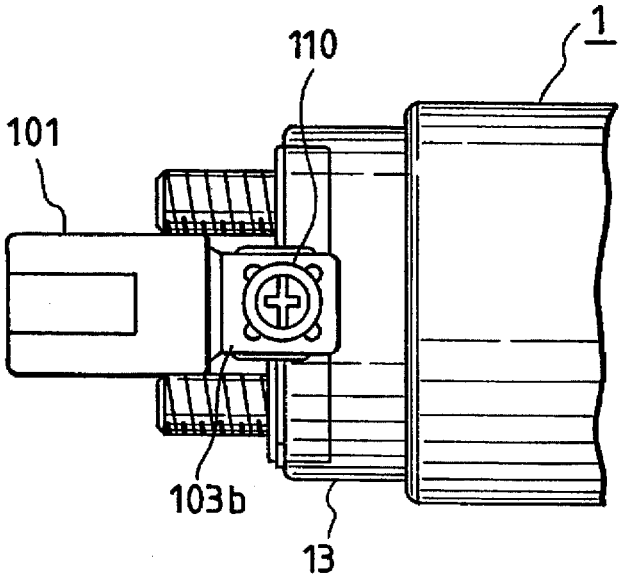
FIG. 7 is a plan view showing how the connecting terminal housing of the starter magnet switch of Embodiment 3 is assembled.
Figure 8:
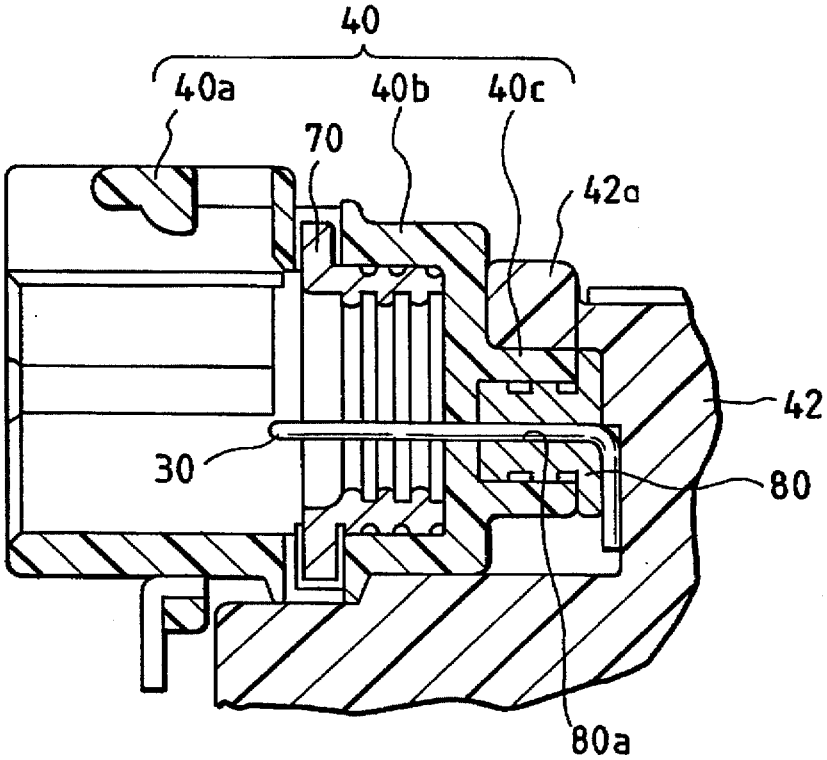
FIG. 8 PRIOR ART
FIG. 8 is a sectional view showing the connecting terminal portion of a conventional starter magnet switch.

As shown in FIGS. 6 and 7, the connecting terminal housing 101 can be fixed in position in a plurality of directions through a combination of the guide projections 111*a* of the fixing terminal 111 and the guide holes 103*c* of the connecting terminal 103. While possible combinations in two directions are suggested in FIGS. 6 and 7, combinations in four directions may be possible if four guide projections 111*a* are arranged on the fixing terminal 111 at positions corresponding to the guide holes 103*c* of the connecting terminal 103.

Further, the insertion of the guide projections 111*a* into the guide holes 103*c* provides the additional advantage of preventing the loosening of the screw 110 when a force is applied to the connecting terminal housing 101.

As described in the foregoing, the invention provides a starter magnet switch that uses a small number of components, that is simply structured, and that requires a small number of assembling process steps in coupling the switching operation current supplying connecting terminal.

In addition, the vehicle-side connector watertight rubber can prevent infiltration of water from the vehicle-side connector housing, which in turn contributes to preventing infiltration of water from outside the connecting terminal housing by the insert-molded resin that is in tight contact.

Further, the invention provides the advantage of preventing the deformation of the connecting terminal housing when a force is applied to the connecting terminal housing.

Furthermore, the invention provides the advantage of not only preventing the deformation of the connecting terminal housing, but also allowing standard products to be used for the connecting terminal side that is to be fitted with the vehicle-side connector.

Moreover, the invention provides the advantage of allowing the connecting terminal to be fixed to the starter magnet switch main body easily as well as reliably.

Still further, the invention provides an advantage of assembling ease because the connecting terminal of the connecting terminal housing is completed by screwing the connecting terminal housing to the fixing terminal that has been fixed to the starter magnet switch main body in advance.

Still further, the invention provides the advantage of not only facilitating the positioning of the fixing terminal with respect to the connecting terminal, but also allowing the fixing terminal and the connecting terminal to be fixed in a plurality of directions. In addition, even if an external force is applied to the connecting terminal housing, the loosening of the screw can be prevented.

Still further, the invention provides the advantage of improving the tight contact between the connecting terminal and the connecting terminal housing, which in turn contributes to increasing watertightness.

What is claimed is:

1. A starter magnet switch comprising:

a starter magnet switch main body;

a connecting terminal for supplying starter magnet switch operating current;

a connecting terminal housing in which the connecting terminal is insert-molded, the connecting terminal housing being attachable to a vehicle-side connector; and a watertight seal member being fitted with an inner wall of the connecting terminal housing so as to prevent infiltration of water from the vehicle-side connector, wherein the connecting terminal is electrically connected to the starter magnet switch, and the connecting terminal mechanically supports said connecting terminal housing on said starter magnet switch main body.

2. A starter magnet switch according to claim 1, wherein a thickness of the connecting terminal on a side to be fixed to the starter magnet switch main body is larger than a thickness thereof on a side to be fitted with the vehicle-side connector.

3. A starter magnet switch according to claim 1, wherein the connecting terminal is set into a recessed portion arranged in a mold cap of the starter magnet switch main body, and wherein the connecting terminal and the mold cap are fixed to each other by an eyelet.

4. A starter magnet switch according to claim 1, wherein said connecting terminal is fixed to a fixing terminal which is fixed to the starter magnet switch main body.

5. A starter magnet switch according to claim 4, wherein a projection is provided on one of surfaces on which the fixing terminal and the connecting terminal are bonded to each other, and wherein an insertion hole for allowing the projection to be inserted thereinto is provided on the other one of the surfaces.

6. A starter magnet switch according to claim 1, wherein a soft viscous resin material is applied to a surface on which the connecting terminal and the connecting terminal housing are bonded to each other.

7. A starter magnet switch according to claim 2, wherein the connecting terminal side to be fixed to the starter magnet switch main body and the connecting terminal side to be fitted with the vehicle-side connector are separate from each other, and wherein both sides are fixed to each other by welding.

8. A starter magnet switch according to claim 2, wherein the connecting terminal is set into a recessed portion arranged in a mold cap of the starter magnet switch main body, and wherein the connecting terminal and the mold cap are fixed to each other by an eyelet.

9. A starter magnet switch according to claim 2, wherein said connecting terminal is fixed to a fixing terminal which is fixed to the starter magnet switch main body.

10. A starter magnet switch according to claim 9, wherein a projection is provided on one of surfaces on which the fixing terminal and the connecting terminal are bonded to each other, and wherein an insertion hole for allowing the projection to be inserted thereinto is provided on the other one of the surfaces.

11. A starter magnet switch according to claim 2, wherein a soft viscous resin material is applied to a surface on which the connecting terminal and the connecting terminal housing are bonded to each other.

12. A starter magnet switch according to claim 7, wherein the connecting terminal is set into a recessed portion arranged in a mold cap of the starter magnet switch main body, and wherein the connecting terminal and the mold cap are fixed to each other by an eyelet.

13. A starter magnet switch according to claim 7, wherein said connecting terminal is fixed to a fixing terminal which is fixed to the starter magnet switch main body.

14. A starter magnet switch according to claim 13, wherein a projection is provided on one of surfaces on which the fixing terminal and the connecting terminal are bonded to each other, and wherein an insertion hole for allowing the projection to be inserted thereinto is provided on the other one of the surfaces.

15. A starter magnet switch according to claim 7, wherein a soft viscous resin material is applied to a surface on which the connecting terminal and the connecting terminal housing are bonded to each other.

* * * * *